US005255956A

United States Patent [19]

Stevens

[11] Patent Number: 5,255,956

[45] Date of Patent: Oct. 26, 1993

[54] ADJUSTABLE ARMREST MOUNTING ASSEMBLY

[75] Inventor: Rex W. Stevens, Clovis, Calif.

[73] Assignee: Quickie Designs Inc., Fresno, Calif.

[21] Appl. No.: 836,093

[22] Filed: Feb. 14, 1992

[51] Int. Cl.[5] ..... A47C 7/54

[52] U.S. Cl. ..... 297/411.26; 297/411.35

[58] Field of Search ..... 297/411, 414, 415, 416, 297/422, 440, 194; 248/118.1, 118.3

[56] References Cited

U.S. PATENT DOCUMENTS

| | | | |
|---|---|---|---|
| 877,274 | 1/1908 | Weber | 297/411 |
| 3,265,436 | 8/1966 | Bombard et al. | 297/414 X |
| 3,614,085 | 10/1971 | Cunningham | 297/411 X |
| 3,767,260 | 10/1973 | Limpach | 297/422 X |
| 3,950,026 | 4/1976 | Van Seenus | 297/411 X |
| 4,674,798 | 6/1987 | Oeth et al. | 297/411 |
| 4,815,688 | 3/1989 | Wood | 297/194 X |
| 5,143,422 | 9/1992 | Althofer et al. | 297/411 |

*Primary Examiner*—Kenneth J. Dorner
*Assistant Examiner*—Milton Nelson, Jr.
*Attorney, Agent, or Firm*—Flehr, Hohbach, Test, Albritton & Herbert

[57] ABSTRACT

An armrest mounting assembly (20) for mounting an inverted, U-shaped, armrest assembly (14) to a wheelchair having a frame (10). The mounting assembly (20) includes a body (22) which is formed to receive an end of the armrest post portions (17). Releasable fasteners (29) couple the body (22) of the armrest mounting block to the wheelchair frame (10). The mounting assembly (20) includes a mounting groove (28) defined by the body (22) proximate a frame engaging surface (24) of the body (22). The groove (28) is formed and dimensioned to slidably receive an enlarged head (36) of the fastener (29) for movement of the mounting block (20) through a plurality of positions along the wheelchair frame member (18) when the fastener (29) is not tightened. This movement permits alignment between the armrest post portion (17) and mounting body (22). Further, the groove (28) retains the head (36) of the fastener (29) against rotation for tightening of the fastener (29) to secure the mounting block (20) in alignment with the spaced apart armrest post portions.

10 Claims, 2 Drawing Sheets

ADJUSTABLE ARMREST MOUNTING ASSEMBLY

TECHNICAL FIELD

The present invention relates, generally, to armrest assemblies for wheelchairs and, more particularly, to armrest mounting assemblies.

BACKGROUND ART

In an effort to ease the overall assembly and increase the portability of wheelchairs, the industry has experienced substantial design changes in recent years. Many individual components are now designed for interchangeability and formed for releasable mounting to their respective mounting structures.

Armrests, for example, are often releasably secured a portion of a wheelchair frame through an armrest mounting assembly which is rigidly affixed to the frame. Typically, an armrest assembly includes an armrest pad which is mounted to an inverted, U-shaped, armrest support frame. This armrest support frame includes a generally horizontal tube portion, which supports the pad, and includes a pair of downwardly extending post portions. Each post portion is usually oriented in a substantially vertical manner for ease of installation and removal from the mounting assembly. Each armrest mounting block or assembly generally is provided by a body which has post receiving opening therein. The post receiving openings are dimensioned to receive the distal ends of the corresponding post portions. By slightly tapering each armrest post end, the post ends gradually wedge or snugly seat against the inner walls of the mounting block as the post ends are pushed down into the armrest mounting blocks.

Wheelchairs generally include a seat assembly mounted to the wheelchair frame and two armrests mounted adjacent to and on opposing sides of the seat assembly. Each armrest requires at least two mounting assemblies or blocks positioned in a spaced-apart relation on one side of the seat assembly, which blocks mount the armrest support frame to the wheelchair frame. These mounting assemblies are usually fixedly mounted to the wheelchair frame at predetermined positions by fasteners, such as bolts. The bolts extend through mounting apertures provided in the mounting assembly or block body. Additionally, aligned apertures are provided in the wheelchair frame so that fasteners extending through the mounting blocks and frame rigidly affix the mounting assembly to the frame. Since the spacing of the armrest mounting assemblies is fixed by fasteners to the frame, the spacing between the downwardly depending post portions of the armrest frame typically must be slightly adjusted to achieve proper alignment between the post ends and the corresponding post receiving apertures of the mounting blocks.

Usually, armrest post ends must be physically bent into alignment with the armrest mounting blocks. This procedure is adequate, but it can be time-consuming and is based upon a trial and error technique. Moreover, the wheelchair user also can experience armrest misalignment difficulties if they remove and re-install the armrests, particularly if the armrest assembly should be dropped during handling. Should this occur, substantial bending may again be required in order to re-install the armrest. This problem can be magnified for those users who are severely physically impaired.

Another problem associated with prior armrest mounting assemblies is that they do not facilitate interchangeability of the armrests. Sometimes, the user may find it desirable to increase or decrease the length of the armrest support frame. With the current mounting assemblies, however, once they are mounted to the wheelchair frame, only those armrests having post ends properly corresponding to the distance between the post receiving apertures of the mounting assemblies may be installed. Another armrest having a horizontal tube portion which is skewed or out of alignment by as little as one-quarter an inch different in length by that amount or less would require either substantial bending of the posts or remounting of one of the mounting assemblies to the wheelchair frame to accommodate the distance change between the posts. Such substantial bending the posts would be subject to the problems already mentioned above.

Accordingly, it is an object of the present invention to provide an armrest mounting assembly which provides ease of adjustment of the alignment of the mounting assemblies to the spacing of the armrest posts.

It is another object of the present invention to provide an armrest mounting assembly which eases installation and removal of the armrest.

Still another object of the present invention is to provide an armrest mounting assembly which promotes interchangeability between the armrests.

It is a further object of the present invention to provide an armrest mounting assembly which is durable, compact, easy to maintain, has a minimum number of components, is easy to use by unskilled personnel, and is economical to manufacture.

The apparatus of the present invention has other objects and features of advantage which will be more readily apparent from the following description of the Best Mode of Carrying Out the Invention and the appended claims, when taken in conjunction with the accompanying drawing.

DISCLOSURE OF INVENTION

The present invention includes an armrest mounting assembly for mounting an armrest to a wheelchair having a frame and an armrest with a mounting post. The mounting assembly includes a body, which is formed to releasably receive an end of the mounting post, and releasable fasteners which couple the body to a mounting surface of the wheelchair frame. The improvement in the armrest mounting assembly comprises, briefly, a frame engaging surface defined by the body and formed to supportably seat against the mounting surface of the wheelchair frame at a plurality of positions along the frame. The mounting assembly further includes a mounting groove defined by the body proximate the frame engaging surface. The groove is formed and dimensioned to slidably receive an enlarged head of the fastener for movement therealong through a plurality of positions along the groove when the fastener is released relative to the mounting surface. Further, the groove is dimensioned to secure the head of the fastener against rotation at the plurality of positions, for securement of the mounting assembly to the frame when the fastener is tightened.

Accordingly, the present invention provides adjustable alignment of the mounting assembly to the spacing of the armrest posts, while further, facilitating installation and removal of the armrests assemblies to a wheelchair frame.

BRIEF DESCRIPTION OF THE DRAWING

The purpose and advantages of the present invention will be apparent to those skilled in the art from the following detailed description in conjunction with the appended drawings in which.

BEST MODE OF CARRYING OUT THE INVENTION

The armrest mounting assembly of the present invention permits alignment between an armrest frame assembly and armrest mounting blocks or assemblies which eases installation and removal of the armrests. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
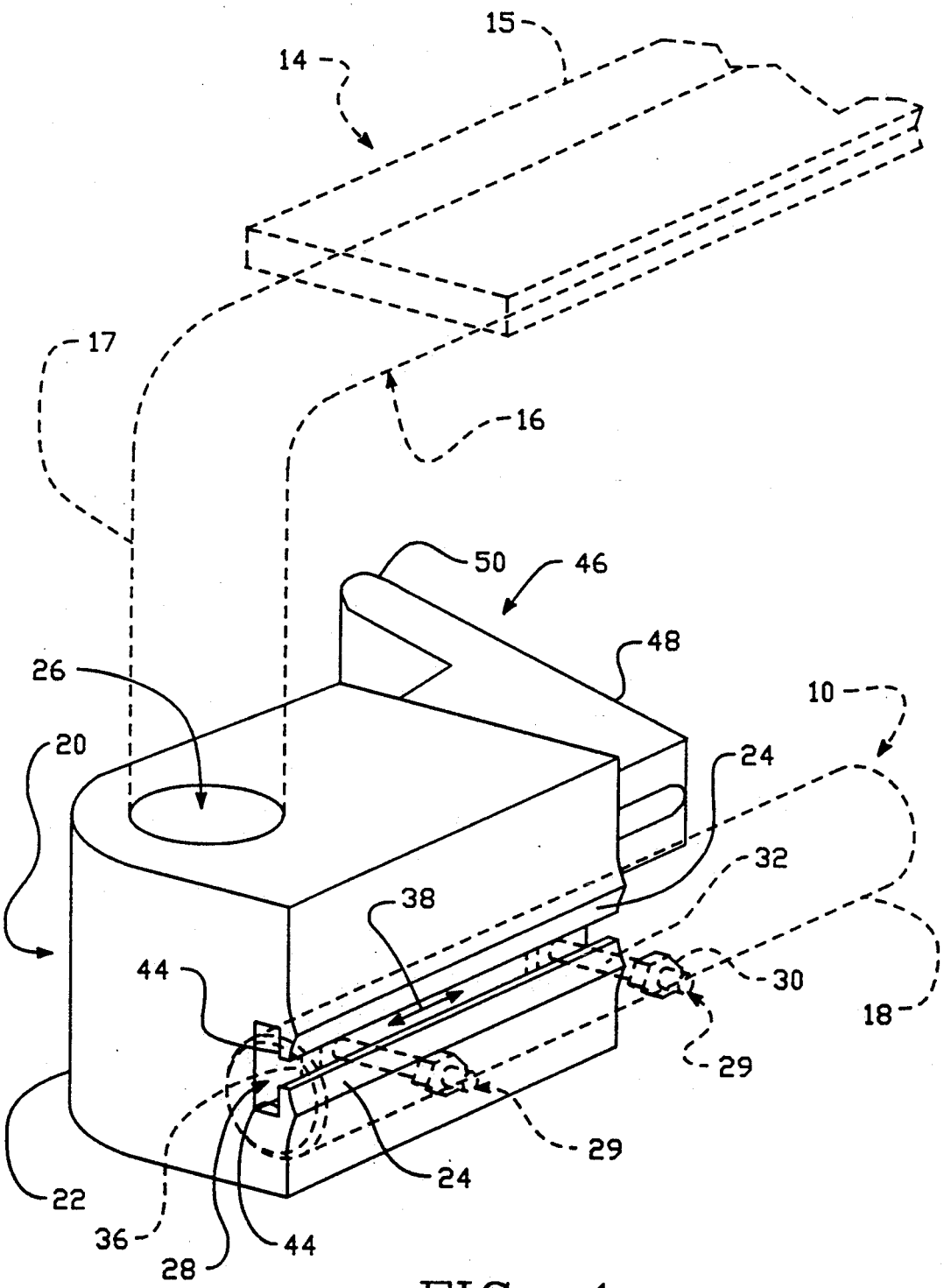
FIG. 1 is a top perspective view of an adjustable armrest mounting assembly constructed in accordance with the present invention and shown in broken lines mounted to a wheelchair frame with an armrest post mounted thereto.

It will be noted here that for a better understanding, like components are designated by like reference numerals throughout the various figures. Attention is now directed to FIG. 1, where an armrest mounting assembly, generally designated 20, is illustrated mounted to a portion of a wheelchair frame member 10 (shown in broken lines). Briefly, armrest mounting assembly 20 of the present invention includes a body, generally designated 22, which defines a wheelchair frame engaging surface 24 preferably formed for mating engagement with a mounting surface 12 (FIG. 2) of wheelchair frame 10. Body 22 includes post receiving means 26 for releasably mounting an armrest assembly 14 (shown in broken lines) thereto, and a mounting groove, generally designated 28.

Armrest assembly 14, generally known in the art, includes an armrest pad 15 and armrest support frame 16. Support frame 16 includes a downwardly extending post portion 17 which is formed for insertion into post receiving bars or opening 26. It will be noted that armrest assembly 14 includes a second post portion (not shown) situated on the opposing end of armrest support 16. Hence, two mounting assemblies 20 preferably couple armrest assembly 14 to wheelchair frame 10. Moreover, a typical wheelchair includes a right side armrest assembly (FIGS. 1-3) and a left side armrest assembly (not shown) which are both positioned adjacent a seat assembly (not shown) carried by wheelchair frame 10. Therefore, usually four mounting assemblies 20 are required to releasably secure the right side and left side armrests to wheelchair frame 10 (i.e., two assemblies apiece).

Similar to the prior art, fasteners, generally designated 29 and often in the form of nuts 30 and bolts 32, are provided at predetermined and fixed positions along frame member 18 which secure armrest mounting assembly 20 thereto. Fasteners 29 extend through bolt apertures 19 in frame support 18 (FIG. 2) and must be capable of being released or tightened to pull mounting block 20 against a mounting surface 12 of armrest frame member 18, as will be discussed in greater detail below. It will be appreciated, however, that fasteners other than a bolt and nut will be capable of being used with the mounting blocks of the present invention without departing from the true spirit and nature of the present invention.

In the preferred embodiment, block body 22 is substantially a solid rectangular body formed of a rigid material such as metal, plastic, ceramic or the like. Body 22, however, can be virtually any geometric shape. In the preferred embodiment, however, armrest post receiving means 26 is provided by a receiving aperture, opening or channel 26 extending vertically through body 22 and is dimensioned to snugly receive the distal end of post portion 17. Post portion 17, as is well known in the art, preferably is slightly tapered radially, increasing in diameter from the distal end in a direction toward armrest pad 15.

In order to telescopically, matingly engage post portion 17 with post receiving opening 26, their respective longitudinal axes must substantially coincide with one another to facilitate easy installation and removal of armrest assembly 14. Although both longitudinal axes may be skewed from the vertical by design, generally post portion 17 and opening 26 with both being vertically oriented.

The reoccurring problem associated with the prior art armrest mounting assemblies is that they were not always properly aligned, and the post portions of the armrest assemblies had to be physically bent to align their ends with the post receiving openings in the mounting blocks. Difficulties resulted when substantial bending was necessary which would skew the post member longitudinal axis from the vertical axis. As mentioned, removal and installation of the armrest assembly would become increasingly difficult, especially for those whose manual dexterity was impaired.

In accordance with the present invention, mounting assembly 20 is provided with a means for aligning the post receiving opening 26 with the corresponding armrest post portion 17. As best viewed in FIGS. 1 and 2, body 22 is formed with a groove 28 positioned adjacent to and extending across frame engaging surface 24. Groove 28 is formed and dimensioned to slidably receive an enlarged head 36 of fastener 29. Unlike the prior art mounting assemblies, body 22 may be repositioned relative to fasteners 29 and armrest frame support 18. Accordingly, mounting block 20 may be moved or displaced through a plurality of positions along frame member 18, and fastener heads 18 will slide in, groove 28, as indicated by arrows 38. Post receiving channel or opening 26 thereby is repositioned into alignment with post portion 17. Thus, the present invention permits substantial adjustment of the armrest mounting block along the longitudinal axis of armrest frame member 18. Not only does this facilitate easy removal and installation of armrest assemblies 14, but also permits a greater degree of interchangeability between armrests of differing length dimensions.

Groove 28 preferably is positioned substantially centrally of frame engaging surface 24 which assists positioning of frame engaging surface 24 against mounting surface 12. Preferably, fasteners 29 are convention bolts having hexagonal heads 36. A cross sectional view of mounting groove 28 (FIG. 3) illustrates that groove 28 is substantially T-shaped with an enlarged area matingly receiving opposed lands of hex-head 36 and a neck portion which slidably receives the bolt shaft 40. Because of the substantial cross-sectional conformity of mounting groove 28 to hexagonal head 36, nut 30 may be turned relative to corresponding bolt 32 to tighten the fastener without rotating the bolt or having to hold bolt 32. Furthermore, although two fasteners 29 are preferable, the present invention may function properly using only one fastener 29 because the cross-sectional conformity of groove 28 prevents bolt rotation while still permitting sliding adjustment of the mounting block on the bolt.

Figure 3:
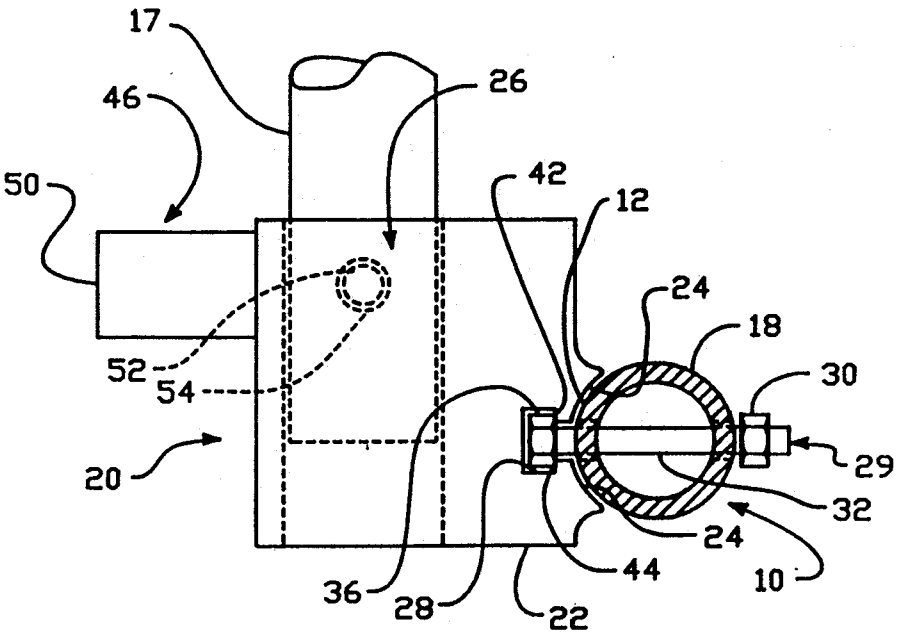
FIG. 3 is a fragmentary, front elevation view, in partial cross-section, of the armrest mounting assembly taken substantially along the plane of line 3—3 in FIG. 2.

As best viewed in FIG. 3, frame engaging surface 24 is formed to substantially mate with mounting surface 12 of armrest frame member 18. FIGS. 1 and 3 illustrate the arcuate or cylindrical shape of frame engaging surface 24 so that frame engaging surface 24 seats substantially flush against mounting surface 12. Together, mounting groove 28 and fasteners 29, in combination with arcuate surface 24, provide stability and securely affix mounting assembly 20 against armrest support frame 18 when fasteners 29 are tightened. Surface 24, of course, may have other shapes and still provide the sliding engagement yet stability required for the adjustable armrest mount of the present invention.

After body 22 has been positioned for receipt, and/or receives armrest frame post portions 17, fasteners 29 are tightened, via nut 30, to secure mounting assembly 20 against mounting surface 12 of frame member 18. As nut 30 is tightened, a bottom lip portion 42 of hexagonal head 36 engages against a wall or shoulder 44 partially defining mounting groove 28. This engagement causes mounting body 22 to be pulled against mounting surface 12.

Figure 2:
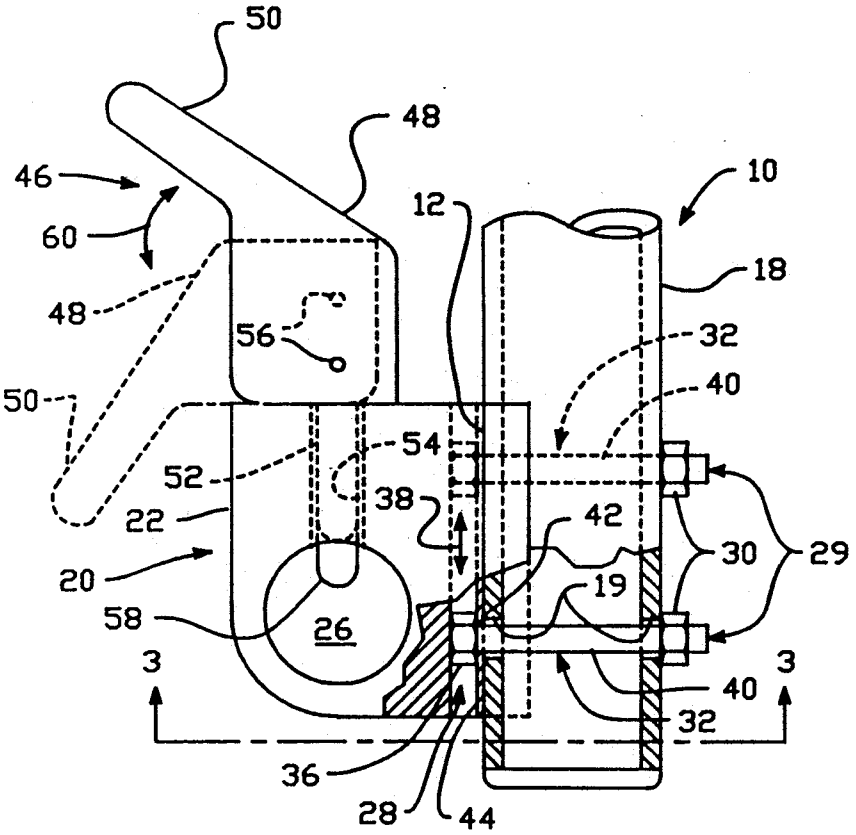
FIG. 2 is a fragmentary, top plan view, partially broken-away, of the armrest mounting assembly of FIG. 1.

In the preferred embodiment, mounting assembly 20 also includes latch means, generally designated 46, which assists in retaining post portions 17 in post receiving openings 26. Latch means 46 includes a latch lever 48 having a handle 50, and a piston or shaft 52 reciprocally retained in a channel 54 in body 22. Latch lever 48 is pivotally mounted, via pin 56, proximate one end of shaft 52, as shown in FIG. 2. The inner end 58 of shaft 52 protrudes radially into post receiving opening 26, and moves between an extended position (shown in solid lines) and a retracted position (shown in broken lines).

Post portion 17 includes a mating aperture (not shown) extending therethrough which is formed to be aligned with and receive the protruding end 58 of retainment shaft 52. Accordingly, when protruding end 58 engages the mating aperture, post portion 17 is retained in receiving aperture 26. A spring means (not shown) biases latch lever 48 in either one of two positions: the extended position which protrudes shaft 52 into post receiving aperture 26; or the retracted position which retracts shaft 52 into shaft aperture 54 (shown in broken lines). Movement of retainment shaft 52 is controlled by latch lever 48. As shown in FIG. 2, retainment shaft 52 may be retracted through the pivotal movement (arrow 60) of latch lever 48 about pin 60. Accordingly, post member 17 may then be removed from mounting block 20.

In the preferred embodiment both mounting blocks 20 used to secure armrest assembly 14 to wheelchair frame 10 are adjustable. It will be understood, however, that it also is possible to provide only one of the armrest mounting assemblies as adjustable assemblies and the other, usually the rear mounting block, as a fixed or conventional mounting block. Additionally, the armrest mounting assembly of the present invention can be used with armrest assemblies in which there is a single mounting post in order to provide a means for adjustment of the position at which the single post is secured to the wheelchair frame.

What is claimed is:

1. In an armrest mounting assembly for mounting an armrest to a wheel chair having frame means, and an armrest with a mounting post, said mounting assembly having a body with post receiving means for releasably receiving an end of said mounting post, and releasable fastener means coupling said body to a mounting surface of said frame means, the improvement in said armrest mounting assembly comprising:

a frame engaging surface on said body formed to supportably seat against said mounting surface at a plurality of locations along said mounting surface; and a mounting groove defined by said body proximate and separate form said frame engaging surface, said groove being formed and dimensioned to receive an enlarged head of said fastener means for sliding movement along said groove through a plurality of positions when said fastener means is released relative to said mounting surface, said fastener means being formed for tightening against said body defining said groove to pull said frame engaging surface against said mounting surface at said plurality of positions to secure said mounting assembly to said mounting surface at a desired location therealong.

2. The armrest mounting assembly as defined in claim 1 wherein, said groove is formed inwardly of said frame engaging surface; and said groove is formed to prevent rotation of said head of said fastener means.

3. The armrest mounting assembly as defined in claim 2 wherein, said mounting groove has a substantially T-shaped cross section and includes a wall facing away from said frame engaging surface and formed to engage said head of said fastener means when said fastener means is tightened relative to said mounting surface.

4. The armrest mounting assembly as defined in claim 3 wherein, said frame engaging surface is arcuate and formed to matingly engage a cylindrical-shaped mounting surface of the frame means.

5. The armrest mounting assembly as defined in claim 3 wherein, said mounting groove extends substantially over a length dimension of said frame engaging surface in a direction along the frame means mounting surface, and substantially at a middle portion of said frame engaging surface.

6. The armrest mounting assembly as defined in claim 3 wherein, said mounting groove is substantially linear.

7. The armrest mounting assembly as defined in claim 6 wherein, a transverse cross section of said mounting groove is substantially rectangular.

8. An armrest mounting assembly for mounting an armrest to a wheelchair having frame means, and an armrest with a mounting post, said armrest mounting assembly comprising:

a body defining a post receiving means for releasably receiving an end of said mounting post;

latch means mounted proximate said post receiving means and releasably securing said end in said post receiving means;

releasable fastener means coupling said body to a mounting surface of said frame means;

a frame engaging surface on said body formed to supportably seat against said mounting surface; and a mounting groove defined by said body proximate and separate from said frame engaging surface, said groove being formed and dimensioned to slidably receive an enlarged head of said fastener means for movement therealong through a plurality of positions along said groove when said fastener means is released relative to said mounting surface, said fastener means being formed for tightening against said body defining said groove to pull and secure said frame engaging surface against said mounting surface at said plurality of positions.

9. The armrest mounting assembly as defined in claim 8 wherein, said mounting groove is positioned inwardly of and centrally to said groove and has a substantially T-shaped cross section with a neck portion providing shoulders facing away from said frame engaging surface, said groove engaging said head of said fastener means and preventing rotation of said fastener means when said fastener means is tightened.

10. The armrest mounting assembly as defined in claim 9 wherein, said frame engaging surface is substantially cylindrical.

* * * * *